US011718093B2

(12) United States Patent
Kim et al.

(10) Patent No.: US 11,718,093 B2
(45) Date of Patent: Aug. 8, 2023

(54) INKJET PRINTING METHOD FOR THIN-FILM COATING

(71) Applicant: UNIJET CO., LTD., Gyeonggi-do (KR)

(72) Inventors: Seog-soon Kim, Gyeonggi-do (KR); Hee-jun Han, Gyeonggi-do (KR); Se-hyun Sim, Incheon (KR); Jong-gyun Lee, Gyeonggi-do (KR)

(73) Assignee: UNIJET CO., LTD., Gyeonggi-Do (KR)

( * ) Notice: Subject to any disclaimer, the term of this patent is extended or adjusted under 35 U.S.C. 154(b) by 64 days.

(21) Appl. No.: 17/617,733

(22) PCT Filed: Feb. 10, 2021

(86) PCT No.: PCT/KR2021/001776

§ 371 (c)(1),
(2) Date: Dec. 9, 2021

(87) PCT Pub. No.: WO2022/131442

PCT Pub. Date: Jun. 23, 2022

(65) Prior Publication Data

US 2022/0402266 A1 Dec. 22, 2022

(30) Foreign Application Priority Data

Dec. 14, 2020 (KR) ..... 10-2020-0174488

(51) Int. Cl.
*B41J 2/115* (2006.01)
*B41J 2/045* (2006.01)

(52) U.S. Cl.
CPC ..... *B41J 2/115* (2013.01); *B41J 2/04516* (2013.01)

(58) Field of Classification Search
CPC ..... B41J 2/2132; B41J 2/115; B41J 2/04516; B41J 2/135; B41J 2/145; B41J 2/15;
(Continued)

(56) References Cited

U.S. PATENT DOCUMENTS

2007/0058204 A1 3/2007 Kakutani
2016/0104842 A1 4/2016 Takeya et al.
(Continued)

FOREIGN PATENT DOCUMENTS

CN 101677111 A 3/2010
KR 10-1111474 B1 3/2012
(Continued)

*Primary Examiner* — Kristal Feggins
(74) *Attorney, Agent, or Firm* — The PL Law Group, PLLC

(57) ABSTRACT

An inkjet printing method may includes a dot pattern printing process of printing a dot pattern group by discharging ink at a preset position of a surface of an object using a nozzle group for forming a dot pattern so that dropped droplets are not in overlap with each other, a connection pattern printing process of printing a connection pattern group by discharging ink at a position between neighboring patterns using a nozzle group for forming a connection pattern so that the same attractive force acts to the neighboring patterns dropped on the surface of the object, and a finishing printing process of finishing a coating of the surface of the object by discharging ink to an area except for neighboring dropped droplets using a nozzle group for finishing so that the same attractive force act to the dropped droplets that are dropped on the surface of the object.

11 Claims, 10 Drawing Sheets

(58) Field of Classification Search
CPC ..... B41J 2/155; B41M 3/00; B41M 3/008; B41M 7/00; B41M 7/0027
See application file for complete search history.

(56) References Cited

U.S. PATENT DOCUMENTS

| | | | | |
|---|---|---|---|---|
| 2019/0283447 | A1* | 9/2019 | Yokozawa | G06T 7/0004 |
| 2020/0039225 | A1* | 2/2020 | Miura | B41J 2/04573 |
| 2020/0207088 | A1* | 7/2020 | Munakata | B41J 2/15 |

FOREIGN PATENT DOCUMENTS

| | | | |
|---|---|---|---|
| KR | 10-2015-0130836 | A1 | 11/2015 |
| KR | 10-2016-0031201 | A | 3/2016 |
| KR | 10-2017-0132956 | A | 12/2017 |
| KR | 10-2017-0132975 | A | 12/2017 |
| TW | 200823070 | A | 6/2008 |

* cited by examiner

INKJET PRINTING METHOD FOR THIN-FILM COATING

CROSS REFERENCE TO RELATED APPLICATIONS AND CLAIM OF PRIORITY

This application claims benefit under 35 U.S.C. 119(e), 120, 121, or 365(c), and is a National Stage entry from International Application No. PCT/KR2021/001776, filed Feb. 10, 2021, which claims priority to the benefit of Korean Patent Application No. 10-2020-0174488 filed in the Korean Intellectual Property Office on Dec. 14, 2020, the entire contents of which are incorporated herein by reference.

BACKGROUND

1. Technical Field

The present invention relates to an inkjet printing method for a thin-film coating, and more particularly, to an inkjet printing method for a thin-film coating, which is capable of preventing dropped ink droplets from pulling each other to be congregated and have a different thickness partially and also overcoming an ink discharge characteristic deviation of each nozzle to minimize a thickness deviation of a coating thin-film.

2. Background Art

In general, an inkjet printing technology includes a process of forming a thin film coating as a process of manufacturing a micro-OLED display formed on a silicon substrate.

For example, FIG. 1 is a view illustrating a cross-sectional structure of the micro-OLED display. The micro-OLED display includes an OCR layer and an organic layer, which are formed through the thin-film coating process.

Particularly, since the micro-OLED display includes a pixel having a small size of 2.4 μm or less, an organic thin-film of the micro-OLED display is required to be coated with an extremely thin thickness of 0.5 μm.

When the organic thin-film of the micro-OLED display has an excessively thick thickness, as shown in FIG. 2, light emitted diagonally from the micro-OLED display may easily cause color interference with a neighboring pixel.

Due to the above-described limitation, the OCR layer for bonding glass or an organic thin-film for an encapsulation layer in the micro-OLED display manufacturing is necessary to have a thickness of 0.5 μm or less.

Here, when coating is performed with a thickness of 0.5 μm or less by using an inkjet head module, a mura may occur as illustrated in FIG. 3 because the coated thin-film has a ununiform thickness by an ink discharge characteristic deviation caused by a minute volume difference of discharged ink droplets between nozzles of the inkjet head module and a phenomenon in which a discharged ink droplet is congregated with another ink droplet after dropped by an attractive force according to different surface states.

That is, the mura occurs by a thickness deviation such that a coating portion having a thin thickness has a green color, and a coating portion having a thick thickness has a brown color, and, in order to prevent this phenomenon, the entire area is necessary to be coated with a thickness deviation of 2% or less.

Thus, in order to solve the above-described limitation of the thin-film thickness deviation, a measure for solving a limitation, in which the ink droplets are not dropped at an exact position by the minute ink discharge characteristic deviation between the nozzles of the inkjet head module and the phenomenon in which a discharged ink droplet is congregated with another ink droplet after dropped by an attractive force according to different surface states, is required.

SUMMARY

The present invention provides an inkjet printing method for a thin-film coating, which is capable of preventing dropped ink droplets from pulling each other to be congregated and have a different thickness and also overcoming an ink discharge characteristic deviation of each nozzle to minimize a thickness deviation of a coating thin-film in order to solve a limitation according to the related art.

In order to solve the technical problem, an inkjet printing method for a thin-film coating of the present invention includes: a dot pattern printing process of printing a dot pattern group by discharging ink at a preset position on a surface of an object using a nozzle group for forming a dot pattern so that dropped droplets are not in overlap with each other; a connection pattern printing process of printing a connection pattern group by discharging ink at a position between a plurality of neighboring dot patterns using a nozzle group for forming a connection pattern so that the same attractive force acts to the plurality of neighboring a dot pattern group pre-printed on the surface of the object; and a finishing printing process of finishing a printing on the surface of the object by discharging ink to an area except for a plurality of neighboring pre-dropped droplets using a nozzle group for finishing a coating pattern so that the same attractive force act to the plurality of finishing printing droplet groups that are dropped on the surface of the object.

Preferably, the nozzle group for forming the dot pattern, the nozzle group for forming the connection pattern, and the nozzle group for finishing a coating pattern may include different nozzle groups in a head module.

Preferably, a size of a droplet discharged through the nozzle group for forming the dot pattern, a size of a droplet discharged through the nozzle group for forming the connection pattern, and a size of a droplet discharged through the nozzle group for finishing may be equal to or different from each other.

Preferably, at least one process of the dot pattern printing process, the connection pattern printing process, and the finishing printing process may discharge a plurality of droplets at the same position to adjust a coating thickness.

Preferably, a coating thickness may be adjusted by adjusting a resolution in a printing direction in the dot pattern printing process, the connection pattern printing process, and the finishing printing process.

Preferably, a ratio between a diameter D of the droplet dropped through the dot pattern printing process and a pitch P1 between the dropped droplets may be $38\% < D/P1 < 93\%$.

Preferably, a ratio between a gap G between the patterns dropped through the connection pattern printing process and a pitch P2 between the dropped patterns may be $9\% < G/P2 < 64\%$.

Preferably, a pixel group including four pixels of an upper left pixel, an upper right pixel, a lower left pixel, and a lower right pixel, which are neighbored on the surface of the object, may be arranged in a grid array. Here, printing may be performed only on a position corresponding to one predetermined pixel of the four pixels in the dot pattern printing process, printing may be performed only on a position corresponding to one predetermined pixel of the rest three pixels in the connection pattern printing process, and printing may be performed only on a position corresponding to one predetermined pixel or two predetermined pixels of the rest two pixels in the finishing printing process.

Preferably, the connection pattern printing process may include: a first connection pattern printing process of printing a first connection pattern group by discharging ink between a plurality of neighboring dot patterns using a nozzle group for forming the first connection pattern so that the same attractive force acts to the plurality of neighboring dot patterns dropped on the surface of the object; and a second connection pattern printing process of printing a second connection pattern group by discharging ink between the plurality of neighboring first connection patterns using a nozzle group for forming the second connection pattern so that the same attractive force acts to the plurality of neighboring first connection pattern dropped on the surface of the object.

Preferably, the nozzle group for forming the first connection pattern and the nozzle group for forming the second connection pattern may include different nozzles in a head module.

Preferably, the inkjet printing method may further include: a leveling process of leveling a coated thickness formed on the surface of the object that has undergone the dot pattern printing process, the connection pattern printing process, and the finishing printing process; and a curing process of curing the coated layer formed on the surface of the object.

The above-described present invention has an advantage of preventing the dropped ink droplets from pulling each other to be congregated and have the different thickness partially and also overcoming the ink discharge characteristic deviation to minimize the thickness deviation of the coating thin-film.

The object of the present invention is not limited to the aforesaid, but other objects not described herein will be clearly understood by those skilled in the art from descriptions below.

DETAILED DESCRIPTION

The present invention may be carried out in various embodiments without departing from the technical ideas or primary features. Therefore, the embodiments of the present invention are merely illustrative, but should not be limitedly interpreted.

It will be understood that although the terms of first and second are used herein to describe various elements, these elements should not be limited by these terms.

The terms are only used to distinguish one component from other components. For example, a first element referred to as a first element in one embodiment can be referred to as a second element in another embodiment without departing from the scope of the appended claims.

As used herein, the term and/or includes any and all combinations of one or more of the associated listed items.

It will also be understood that when an element is referred to as being "'connected to" or "engaged with" another element, it can be directly connected to the other element, or intervening elements may also be present.

It will also be understood that when an element is referred to as being 'directly connected to' another element, there is no intervening elements.

In the following description, the technical terms are used only for explaining a specific exemplary embodiment while not limiting the present invention. The terms of a singular form may include plural forms unless referred to the contrary.

The meaning of 'include' or 'comprise' specifies a property, a number, a step, a process, an element, a component, or a combination thereof in the specification but does not exclude other properties, numbers, steps, processes, elements, components, or combinations thereof.

Unless terms used in the present disclosure are defined differently, the terms may be construed as meaning known to those skilled in the art.

Terms such as terms that are generally used and have been in dictionaries should be construed as having meanings matched with contextual meanings in the art. In this description, unless defined clearly, terms are not ideally, excessively construed as formal meanings.

Hereinafter, embodiments disclosed in this specification is described with reference to the accompanying drawings, and the same or corresponding components are given with the same drawing number regardless of reference number, and their duplicated description will be omitted.

Moreover, detailed descriptions related to well-known functions or configurations will be ruled out in order not to unnecessarily obscure subject matters of the present invention.

Firstly, a pixel definition on a surface of an object for a thin-film coating will be described.

Figure 5:
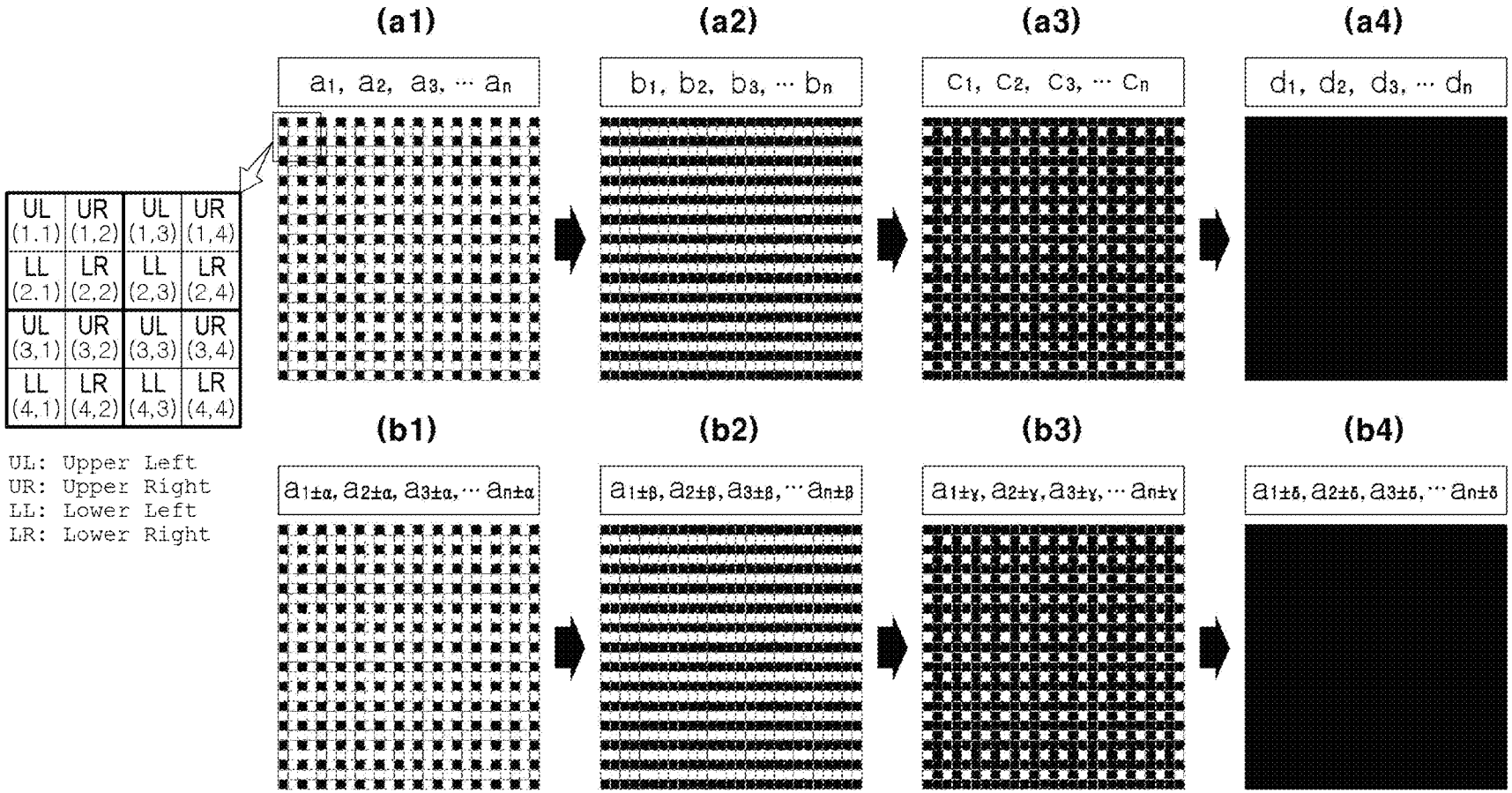
FIG. 5 is a view illustrating a detailed printing process of the inkjet printing method for the thin-film coating according to an embodiment of the present invention.

As illustrated in FIG. 5, the surface of the object may be defined such that a plurality of pixels are arranged in a grid array, and more particularly, a pixel group including four pixels (an upper left pixel, an upper right pixel, a lower left pixel, and a lower right pixel), which are adjacent to each other in a specific area and arranged in a grid array, is repeated in horizontal and vertical directions to be arranged in a grid array.

For example, as illustrated in (a1) of FIG. 5, the surface of the object may include a plurality of pixels, a pixel disposed at an uppermost and left side end may be defined as the upper left pixel (a coordinate of (1,1)), a pixel disposed at a right side of the upper left pixel may be defined as the upper right pixel (a coordinate of (1,2)), a pixel disposed below the upper left pixel may be defined as the lower left pixel (a coordinate of (2,1)), and a pixel disposed below the upper right pixel may be defined as the lower right pixel (a coordinate of (2,2)).

Thus, as four pixels of the coordinates of (1,1), (1,2), (2,1), and (2,2) form one pixel group, and the pixel group is repeated in the horizontal and vertical directions to be arranged in the grid array, each of the pixels on the entire surface of the object may be defined as one of the upper left pixel, the upper right pixel, the lower left pixel, and the lower right pixel.

That is, the upper left pixel, the upper right pixel, the upper left pixel, the upper right pixel, . . . , the upper left pixel may be repeated in the horizontal direction from the coordinate of (1,1), and the upper left pixel, the lower left pixel, the upper left pixel, the lower left pixel, . . . , the upper left pixel may be repeated in the vertical direction from the coordinate of (1,1).

Also, the lower left pixel, the lower right pixel, the lower left pixel, the lower right pixel, . . . , the lower left pixel may be repeated in the horizontal direction from the coordinate of (2,1), and the upper right pixel, the lower right pixel, the upper right pixel, the lower right pixel, . . . , the upper right pixel may be repeated in the vertical direction from the coordinate of (1,2).

As described above, the surface of the object may be defined such that the pixel group defined by the upper left pixel, the upper right pixel, the lower left pixel, and the lower right pixel is repeated to be arranged in the grid array.

Figure 4:
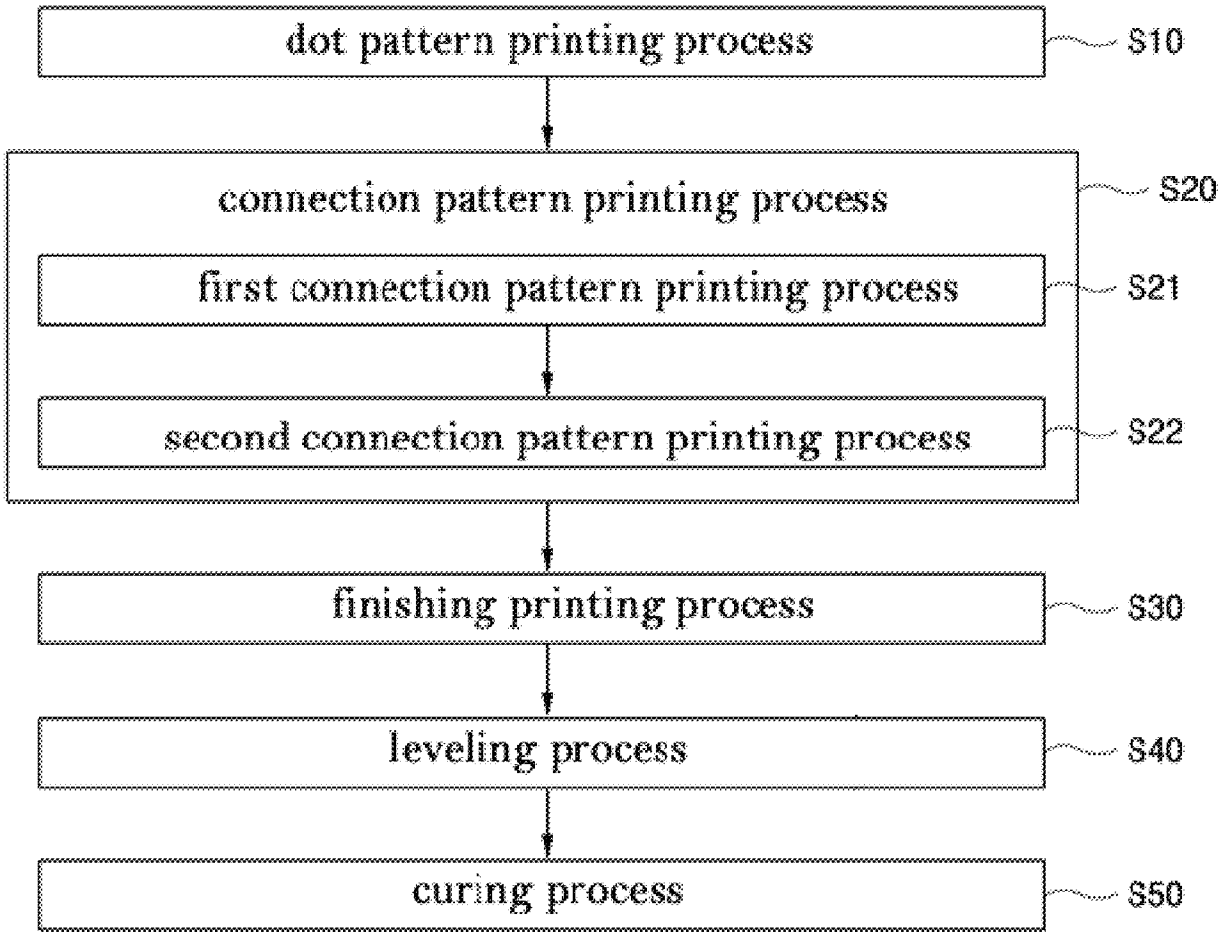
FIG. 4 is a flowchart showing an order of an inkjet printing method for a thin-film coating according to an embodiment of the present invention.

As illustrated in FIG. 4, an inkjet printing method for a thin-film coating according to an embodiment of the present invention for coating a thin-film on the surface of the object, which is defined as described above, includes a dot pattern printing process S10, a connection pattern printing process S20 including a first connection pattern printing process S21 and a second connection pattern printing process S22, a finishing printing process S30, a leveling process S40, and a curing process S50.

When a total amount of ink consumed for coating the thin-film on the surface of the object is assumed as 100 percentage by weight, a sum of an amount of ink discharged through the dot pattern printing process S10, an amount of ink discharged through the connection pattern printing process S20, and an amount of ink discharged through the finishing printing process S30 corresponds to 100 percentage by weight.

For example, as illustrated in FIG. 4, when printing is performed by four processes including the dot pattern printing process S10, the first connection pattern printing process S21, the second connection pattern printing process S22, and the finishing printing process S30, the processes may be performed so that 100 percentage by weight of the ink is printed by discharging 25 percentage by weight of the ink for each process, which correspond to about 25% of the 100 percentage by weight of the total ink amount. Although a different amount of ink may be discharged for each process by adjusting the discharged ink amount for each process, the total amount of the ink printed when all printing processes are completed becomes 100 percentage by weight.

Firstly, the dot pattern printing process S10 will be described.

The dot pattern printing process S10 is a process of printing a dot pattern group by discharging the ink at a preset surface position of the object using a nozzle group for forming a dot pattern so that dropped ink droplets (hereinafter, referred to as 'droplets') are not in overlap with each other.

For example, as illustrated in (a1) of FIG. 5, each of the droplets may be printed only on a position of the upper left pixel in the dot pattern printing process S10. That is, the droplets are printed in correspondence to pixel positions of (1,1), (1,3), (1,5), . . . , (3,1), . . . , (5,1), . . . corresponding to the upper left pixels so that the droplets are not in overlap with each other.

As described above, as the printing is performed only on the positions of the upper left pixels so that the dropped droplets are not in overlap with each other, the printing may be performed in a state in which an attractive force does not act to the neighboring dropped droplets, and the dot pattern group may be formed through the dot pattern printing process S10.

Here, the attractive force between the dropped droplets represents a force acting such that interfaces of a plurality of droplets closely contact or overlap each other, and the plurality of droplets pull each other to be congregated into one droplet.

Figure 6:
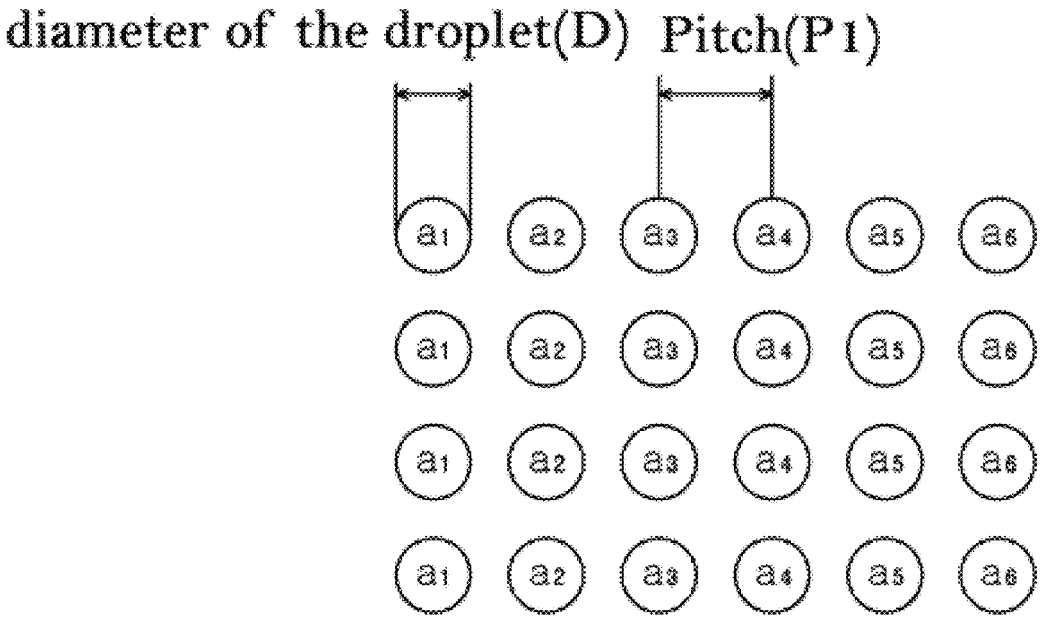
FIGS. 6 and 7 are views illustrating detailed shapes of a droplet and a pattern of the inkjet printing method for the thin-film coating according to an embodiment of the present invention.

As illustrated in FIG. 6, a ratio between a diameter D of the droplet dropped through the dot pattern printing process S10 and a pitch P1 between the dropped droplets may be $38\% < D/P1 < 93\%$. That is, the pitch between the droplets and the diameter of the droplet after dropped are determined, according to a target coating thickness, by considering characteristics such as a surface state (surface tension, roughness, etc.) of a material, a diameter of the droplet dropped on a following printing path, a printing accuracy of the droplet, a behavior characteristic of forming the droplet when dropped, uniformity of an edge of a coating surface, and a spread characteristic of the droplet on a surface as time elapses.

The dot pattern group may be formed by printing in a state in which the attractive force does not act between the dropped droplets through the above-described dot pattern printing process S10. As the printing is performed in the above-described state in which the attractive force does not act between the dropped droplets, a predetermined amount of ink may be exactly printed at a predetermined position.

Next, the connection pattern printing process S20 will be described.

The connection pattern printing process S20 is a process of printing a connection pattern group by discharging the ink between a plurality of neighboring patterns using a nozzle group for forming the connection pattern so that the same attractive force acts between the plurality of neighboring patterns dropped on the surface of the object.

For example, the connection pattern printing process S20 is a process of printing so that the same attractive force acts to the droplets dropped at left-right and upper-lower portions.

The connection pattern printing process S20 may include the first connection pattern printing process S21 and the second connection pattern printing process S22.

The first connection pattern printing process S21 is a process of printing a first connection pattern group by discharging the ink between the plurality of neighboring dot patterns using a nozzle group for forming the first connection pattern so that the same attractive force acts to the plurality of neighboring patterns dropped on the surface of the object.

For example, as illustrated (a2) of FIG. 5, each of the droplets may be printed only on a position of the upper right pixel in the first connection pattern printing process S21. That is, the droplets are printed in correspondence to pixel positions of (1.2), (1.4), (1.6), . . . , (3.2), . . . , (5.2), . . . corresponding to the upper right pixels.

As described above, as the printing is performed only the position of the upper right pixel, each of the dropped droplets may be printed in a state in which the same attractive force acts to each of the droplets previously dropped on both side upper left pixels, and a predetermined amount of ink may be printed exactly at a predetermined position.

Figure 7:
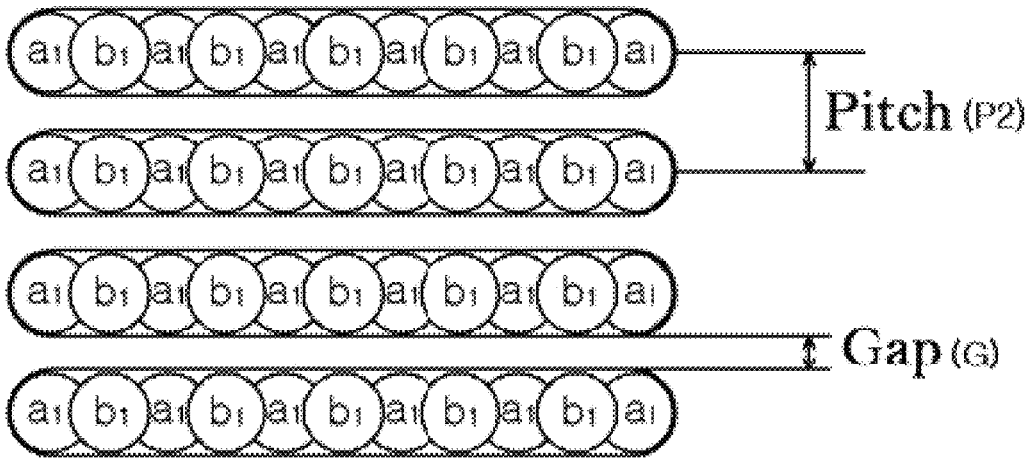

As illustrated in FIG. 7, the linear first connection pattern group may be formed through the above-described first connection pattern printing process S21.

Here, as illustrated in FIG. 7, a ratio between a gap G between patterns dropped through the first connection pattern printing process S21 and a pitch P2 between the dropped patterns may be 9%<G/P2<64%. This is determined by considering characteristics such as a surface state (surface tension, roughness, etc.) of a material, a thickness of the droplet dropped on a following printing path, a printing accuracy of the droplet, a behavior characteristic of forming the droplet when dropped, uniformity of an edge of a coating surface, and a spread characteristic of the droplet on a surface as time elapses.

As the first connection pattern printing process S21 is performed in the state in which the same attractive force acts between the droplets previously dropped on both side upper left pixels as described above, a predetermined amount of ink may be exactly printed at a predetermined position The second connection pattern printing process S22 is a process of printing a second connection pattern group by discharging the ink between the plurality of neighboring first connection patterns using a nozzle group for forming the second connection pattern so that the same attractive force acts to the plurality of neighboring first connection pattern dropped on the surface of the object.

For example, as illustrated (a3) of FIG. 5, each of the droplets may be printed only on a position of the lower right pixel in the second connection pattern printing process S22. That is, the droplets are printed in correspondence to the pixel positions of (2.2), (2.4), (2.6), . . . , (4.2), . . . , (6.2), . . . corresponding to the lower right pixels.

As described above, as the printing is performed only on the position of the lower right pixel, each of the dropped droplets may be printed in a state in which the same attractive force acts to each of both side first connection patterns, and a predetermined amount of ink may be exactly printed at a predetermined position to form the second connection pattern group having a shape in black color of (a3) of FIG. 5.

Next, the finishing printing process S30 will be described.

The finishing printing process S30 is a process of finishing the coating on the surface of the object by discharging the ink to an area except for the plurality of neighboring dropped droplets using a nozzle group for finishing so that the same attractive force act to the plurality of dropped droplets that are dropped on the surface of the object.

For example, as illustrated (a4) of FIG. 5, each of the droplets may be printed only on a position of the lower left pixel in the finishing printing process S30. That is, the droplets are printed in correspondence to the pixel positions of (2.1), (2.3), (2.5), . . . , (4.1), . . . , (6.1), . . . corresponding to the lower left pixels.

As described above, as the printing is performed only on the lower left pixels, the droplet dropping over the entire surface of the object may be completed.

As described above, as the printing is performed only on positions of the lower left pixels, the droplets discharged and dropped in the finishing printing process may be printed in a state in which the same attractive force act to each of the plurality of droplets that are previously dropped in a previous process, and a predetermined amount of ink may be exactly printed at a predetermined position.

As described above, the predetermined amount of ink may be exactly printed at the predetermined position over the entire surface of the object through the dot pattern printing process S10, the first connection pattern printing process S21, the second connection pattern printing process S22, and the finishing printing process S30.

Although the printing is performed on each of the upper left pixel in the dot pattern printing process S10, the upper right pixel in the first connection pattern printing process S21, the lower right pixel in the second connection pattern printing process S22, and the lower left pixel in the finishing printing process S30, the position of the pixel printed in each process may be converted to each other.

That is, the printing may be variously changed such that the printing is performed on each of the lower left pixel in the dot pattern printing process S10, the lower right pixel in the first connection pattern printing process S21, the upper right pixel in the second connection pattern printing process S22, and the upper left pixel in the finishing printing process S30 as long as the printing is performed only on the pixel corresponding to one position in one process.

A detailed configuration and relationship of the nozzle group for forming the dot pattern, the nozzle group for forming the first connection pattern, the nozzle group for forming the second connection pattern, and the nozzle group for finishing, which discharge the droplets in the dot pattern printing process S10, the connection pattern printing process S20, and the finishing printing process S30, will be described in detail.

The nozzle group for forming the dot pattern, the nozzle group for forming the first connection pattern, the nozzle group for forming the second connection pattern, and the nozzle group for finishing may include different nozzles that are not in overlap with each other in a head module and will be described with reference to (a1) to (a4) of FIG. 5.

For example, the nozzle group for forming the dot pattern may include a1, a2, a3, . . . an nozzles selected from the plurality of nozzles of the inkjet head module.

Also, the nozzle group for forming the first connection pattern may include b1, b2, b3, . . . bn nozzles selected from the plurality of nozzles of the inkjet head module.

Also, the nozzle group for forming the second connection pattern may include c1, c2, c3, . . . cn nozzles selected from the plurality of nozzles of the inkjet head module.

Finally, the nozzle group for finishing may include d1, d2, d3, . . . dn nozzles selected from the plurality of nozzles of the inkjet head module.

Here, each of the plurality of nozzles of the nozzle group for forming the dot pattern may have the same pitch as the pitch P1 between the dropped droplets, and each of the plurality of nozzles of the nozzle group for forming the first connection pattern, the plurality of nozzles of the nozzle group for forming the second connection pattern, and the plurality of nozzles of the nozzle group for finishing may also have the same pitch as the pitch P1.

For a specific example, when the inkjet head module includes total 100 nozzles that are serially arranged with the pitch P1, the nozzle group for forming the dot pattern may include $1^{st}$ to $25^{th}$ nozzles, the nozzle group for forming the first connection pattern may include $26^{th}$ to $50^{th}$ nozzles, the nozzle group for forming the second connection pattern may include $51^{th}$ to $75^{th}$ nozzles, and the nozzle group for finishing may include 76th to 100th nozzles.

For another example, the nozzle group for forming the dot pattern may include odd or even numbered nozzles of $1^{st}$ to $50^{th}$ nozzles, the nozzle group for forming the first connection pattern may include odd or even numbered nozzles of $20^{th}$ to $70^{th}$ nozzles, the nozzle group for forming the second connection pattern may include odd or even numbered nozzles of $40^{th}$ to $90^{th}$ nozzles, and the nozzle group for finishing may include odd or even numbered nozzles of $50^{th}$ to $100^{th}$ nozzles. That is, each of the nozzle groups may be configured with a gap of one or a plurality of nozzles.

That is, the nozzle group for forming the dot pattern, the nozzle group for forming the first connection pattern, the nozzle group for forming the second connection pattern, and the nozzle group for finishing may include different nozzles in the head module.

The head module may have a width greater than that of the object to be coated. More particularly, the head module may include one head having a width greater than that of the object or a plurality of heads each of which has a width less than that of the object and which are serially connected.

For another example, the nozzle group for forming the dot pattern, the nozzle group for forming the first connection pattern, the nozzle group for forming the second connection pattern, and the nozzle group for finishing may include different nozzles while a portion of the nozzles overlap in the head module, and this will be described with reference to (b1) to (b4) of FIG. 5.

For example, the nozzle group for forming the dot pattern may include a1+α, a2+α, a3+α, . . . an+α nozzles selected from the plurality of nozzles of the inkjet head module.

Also, the nozzle group for forming the first connection pattern may include a1+β, a2+β, a3+β, . . . an+β nozzles selected from the plurality of nozzles of the inkjet head module.

Also, the nozzle group for forming the second connection pattern may include a1+γ, a2+γ, a3+γ, . . . an+γ nozzles selected from the plurality of nozzles of the inkjet head module.

Finally, the nozzle group for finishing may include a1+δ, a2+δ, a3+δ, . . . an+δ nozzles selected from the plurality of nozzles of the inkjet head module.

Here, each of the plurality of nozzles of the nozzle group for forming the dot pattern may have the same pitch as the pitch P1 between the dropped droplets, and each of the plurality of nozzles of the nozzle group for forming the first connection pattern, the plurality of nozzles of the nozzle group for forming the second connection pattern, and the plurality of nozzles of the nozzle group for finishing may also have the same pitch as the pitch P1.

For a specific example, when the inkjet head module includes total 55 nozzles that are serially arranged with the pitch P1, the nozzle group for forming the dot pattern may include $1^{st}$ to $25^{th}$ nozzles, the nozzle group for forming the first connection pattern may include $11^{th}$ to $35^{th}$ nozzles, the nozzle group for forming the second connection pattern may include $21^{th}$ to $45^{th}$ nozzles, and the nozzle group for finishing may include $31^{th}$ to $55^{th}$ nozzles.

That is, the nozzle group for forming the dot pattern, the nozzle group for forming the first connection pattern, the nozzle group for forming the second connection pattern, and the nozzle group for finishing may include different nozzles while a portion of the nozzles overlap by being shifted in a longitudinal direction as many as a distance corresponding to a gap of predetermined nozzles in the head module.

Here, each of the nozzle group for forming the dot pattern, the nozzle group for forming the first connection pattern, the nozzle group for forming the second connection pattern, and the nozzle group for finishing may include at least two nozzles that are shifted in position.

That is, when the nozzle group for forming the dot pattern includes $1^{st}$ to $25^{th}$ nozzles, and the nozzle group for forming the first connection pattern includes $2^{nd}$ to $26^{th}$ nozzles, the $1^{st}$ nozzle and the $2^{nd}$ nozzle may be resultantly printed to be directly neighbored, and the directly neighbored nozzles may not be used for each process.

Although all of the nozzle group for forming the dot pattern, the nozzle group for forming the first connection pattern, the nozzle group for forming the second connection pattern, and the nozzle group for finishing include different nozzles in the above embodiments, a portion of the groups may use the same nozzle.

That is, the nozzle group for forming the dot pattern and the nozzle group for finishing may use the same nozzle as each other, and only the nozzle group for forming the first connection pattern, the nozzle group for forming the second connection pattern, and the nozzle group for finishing may use different nozzles.

Also, a size of the droplet discharged through the nozzle group for forming the dot pattern, a size of the droplet discharged through the nozzle group for forming the connection pattern, and a size of the droplet discharged through the nozzle group for finishing may be equal to or different from each other.

Also, at least one among the dot pattern printing process S10, the connection pattern printing process S20, and the finishing printing process S30 may be configured to adjust a coating thickness by discharging a plurality of droplets at the same position.

That is, a case when two droplets are discharged at the same position may have a coating thickness greater than that of a case when one droplet is discharged.

Also, the coating thickness may be adjusted by adjusting a resolution in a printing direction in the dot pattern printing process S10, the connection pattern printing process S20, and the finishing printing process S30.

That is, the coating thickness may be adjusted such that a case when the printing is performed with a resolution of 500 dpi (dot per inch) has a density of the dropped droplets greater than that of a case when the printing is performed with a resolution of 400 dpi.

According to the above-described detailed configuration and relationship of the nozzle group for forming the dot pattern, the nozzle group for forming the first connection pattern, the nozzle group for forming the second connection pattern, and the nozzle group for finishing, the directly neighbored nozzle of the inkjet head module may be restricted when the printing is performed on the directly neighbored pixel.

Figure 1:
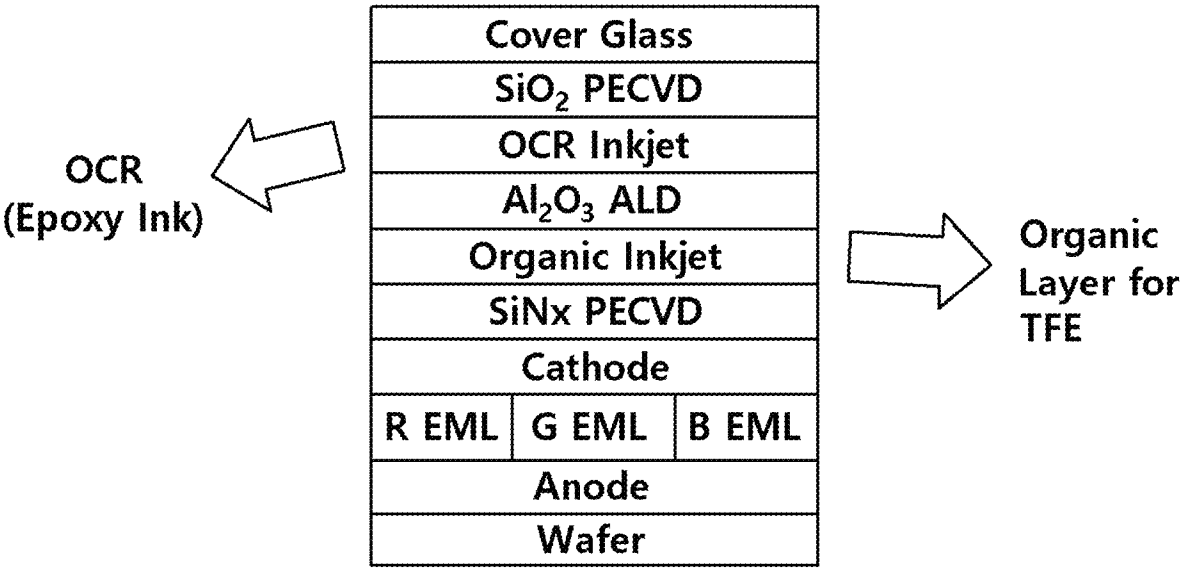
FIG. 1 is a cross-sectional view illustrating a cross-sectional structure of a general micro-OLED display.
Figure 2:
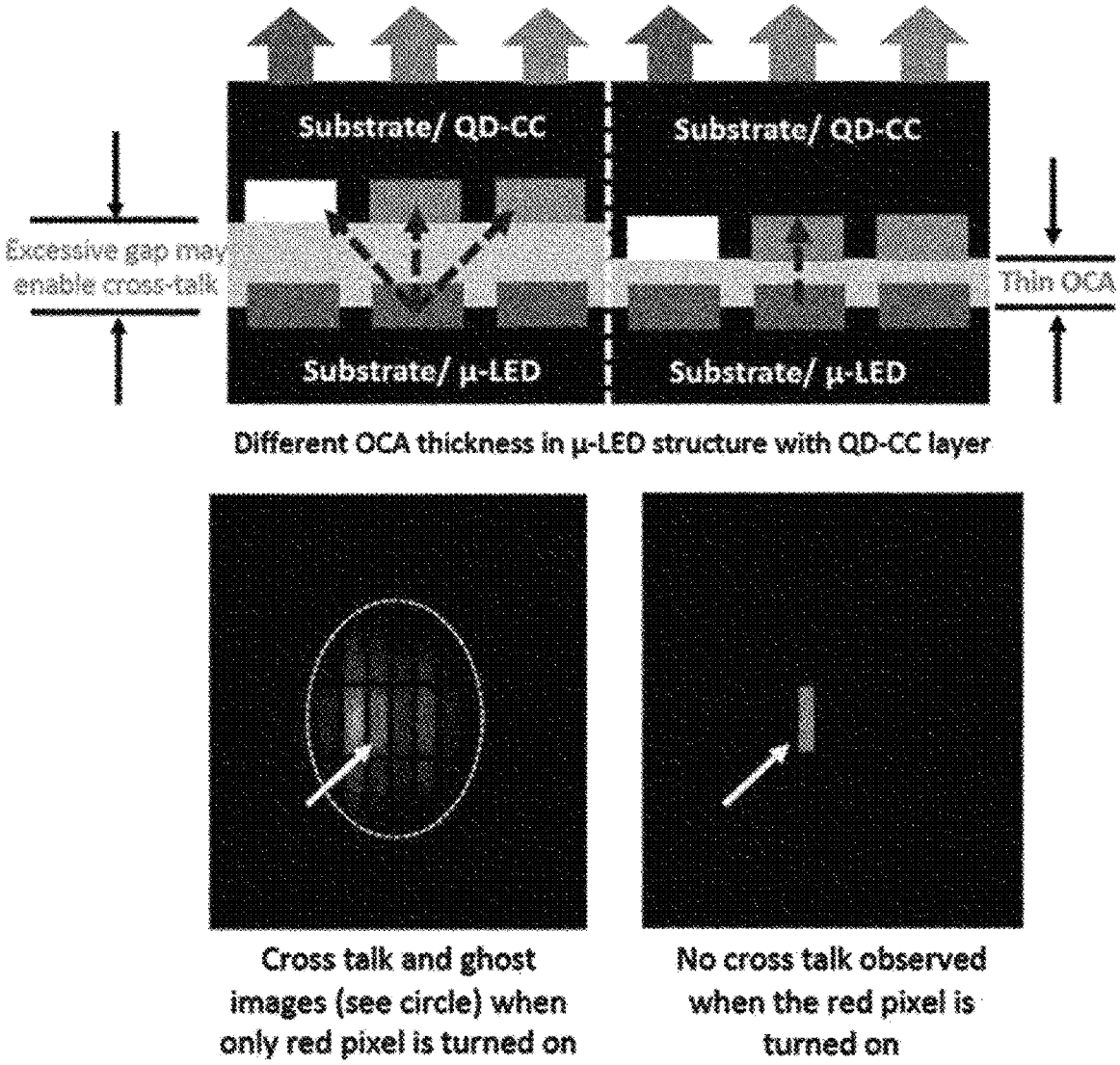
FIG. 2 is a view for explaining the light interference between pixels of a micro-OLED.
Figure 3:
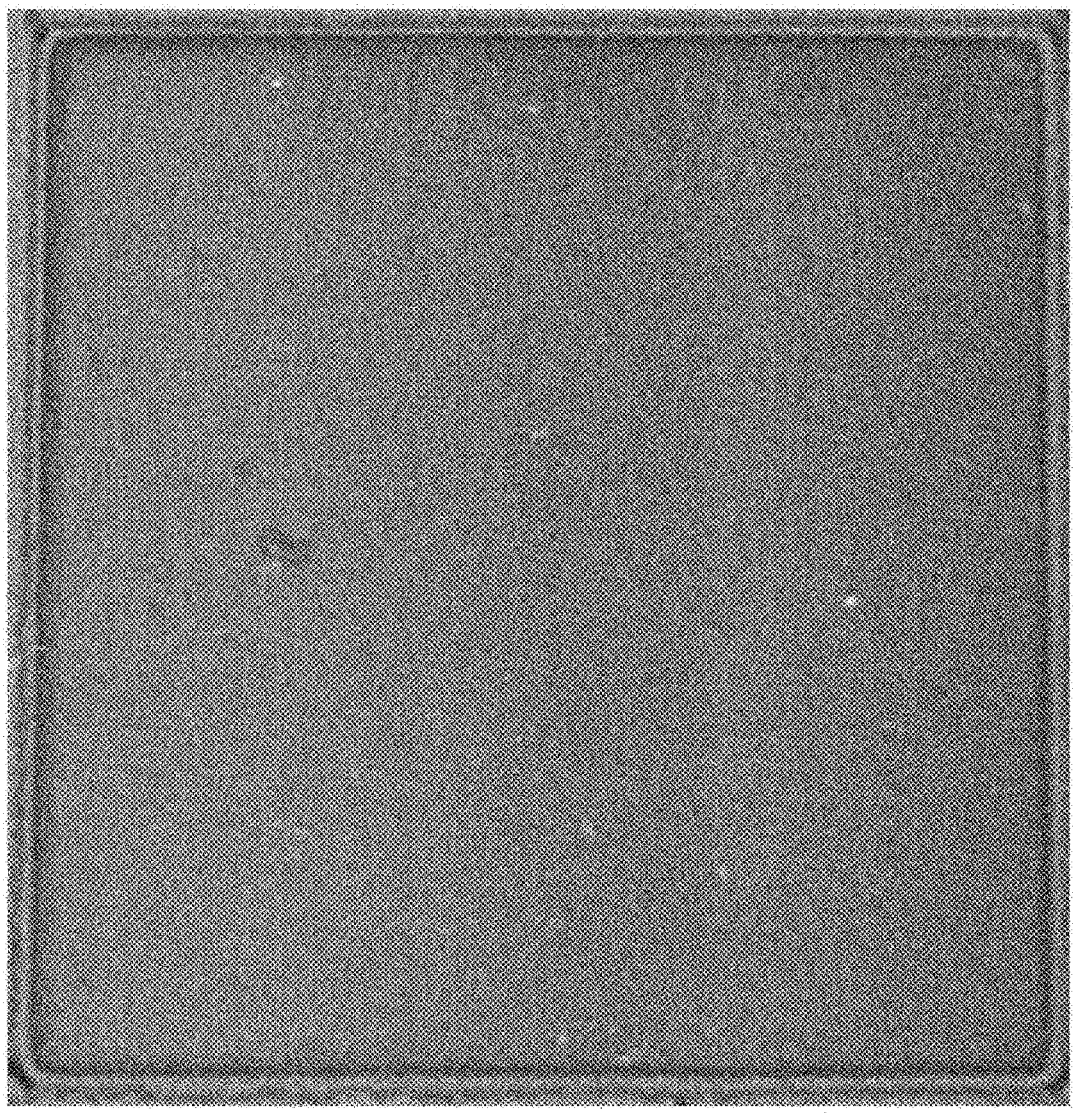
FIG. 3 is a view illustrating a mura generated as a coated thin-film has an ununiform thickness.
Figure 8:
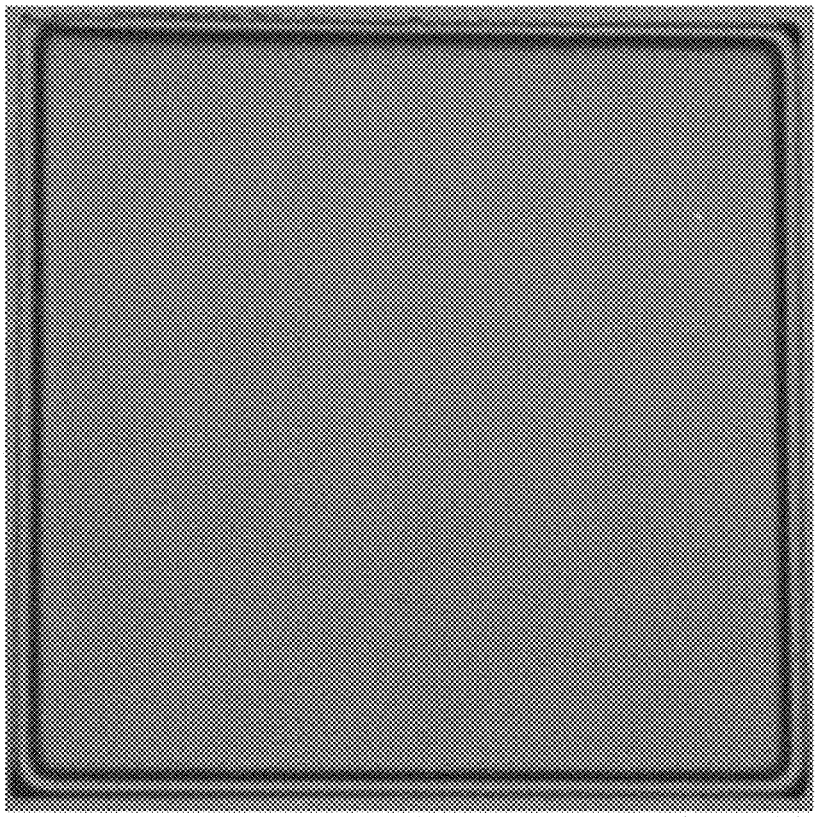
FIG. 8 is a view illustrating a state coated by the inkjet printing method for the thin-film coating according to an embodiment of the present invention.

That is, when described based on the pixels of coordinates (1,1), (1,2), (1,3), . . . , (1,n), it may be restricted that the 1st nozzle is used for the pixel of the coordinate (1,1), the 2nd nozzle is used for the pixel of the coordinate (1,2), the 3rd nozzle is used for the pixel of the coordinate (1,3), and nth nozzle is used for the pixel of the coordinate (1,n). As a volume deviation of the discharged droplet is generated according to a nozzle area or a different row of the nozzle like the related art, a mura phenomenon generated by the volume deviation of the droplets having various shapes, as illustrated in FIG. 3, may be prevented, an ink discharge characteristic deviation of each nozzle may overcome, and a thickness deviation of the coating thin film may be minimized to perform the coating in a satisfactory state as illustrated in FIG. 8.

The most important concept of the present invention is to prevent the droplets dropped in the dot pattern printing process performing primary printing from overlapping and being congregated with each other. That is, the present invention fundamentally removes a phenomenon in which an ink droplet dropped slightly earlier pulls an ink droplet dropped later to be congregated with each other even in one process by an attractive force (force of pulling each other) generated when ink drops overlap.

After the dot pattern printing process, as a droplet discharged from a nozzle at a different position is dropped between droplets dropped previously in a previous process by adjusting a nozzle position to be changed in the connection pattern printing process and the finishing printing process, a uniform attractive force may act from each of the previously dropped droplets, and a drop position of the droplet may be exactly maintained in all processes.

That is, as the same nozzle or the directly adjacent nozzle of the inkjet head module is restricted to be used for the upper left pixel, the upper right pixel, the lower left pixel, and the lower right pixel of one pixel group, the nozzle disposed at a position spaced by at least two nozzle gaps may be applied to the upper left pixel, the upper right pixel, the lower left pixel, and the lower right pixel of one pixel group to overcome the ink discharge characteristic deviation of each nozzle.

For example, when the printing process is divided into four processes of the dot pattern printing process S10, the first connection pattern printing process S21, the second connection pattern printing process S22, and the finishing printing process S30, an entire printing image may be formed by four images with a uniform pixel gap.

Since each section is printed by using the nozzle at a different position instead of using the same nozzle or the directly adjacent nozzle when each image is coated, the volume difference of the ink drops generated in each nozzle may be compensated.

Also, since the present invention is a coating method of allowing the attractive forces of the ink drops dropped at upper-lower or left-right portions to be uniform, when the head module has a width less than that of the area, a visible discontinuous line may be generated by an attractive force of ununiform ink drops at an end point of the nozzle of the head module in the connection pattern printing process which drops ink drops between the previously dropped ink drops. In this case, the discontinuous line may be less visible by adjusting a position of the head module, i.e., a position of the nozzle, to be closer to the existing printing direction than the existing pitch when the head module moves from the line at which the discontinuous line is generated and prints a next printing area. However, in order to basically resolve the above-described limitation, the printing may be easily performed on the entire area by installing the head module having a width much greater than that of the coating image and mixing positions of the nozzles, or the printing may be performed so that the discontinuous line is not visible at all.

Next, the leveling process S40 will be described.

The leveling process S40 is a process of leveling the coating formed on the surface of the object that has undergone the dot pattern printing process S10, the connection pattern printing process S20, and the finishing printing process S30.

Specifically, the leveling process S40 levels the thickness of the uncured coating formed on the surface of the object that has undergone the dot pattern printing process S10, the connection pattern printing process S20, and the finishing printing process S30.

Next, the curing process S50 will be described.

The curing process S50 is a process of curing the coating formed on the surface of the object.

Specifically, the curing process S50 irradiates ultraviolet (UV) light to cure the leveled coating formed on the surface of the object that has undergone the dot pattern printing process S10, the connection pattern printing process S20, and the finishing printing process S30.

Figure 9:
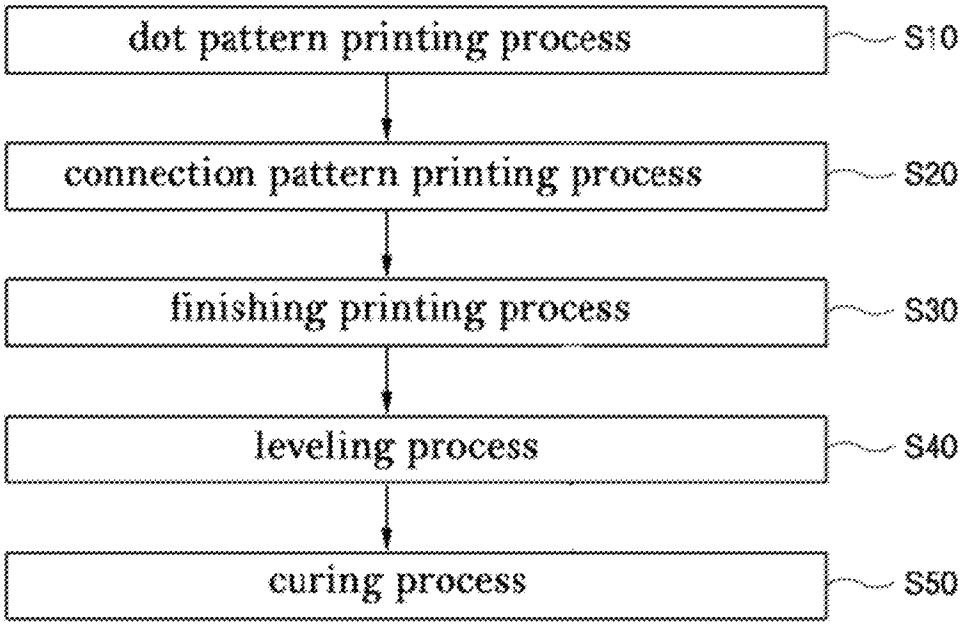
FIG. 9 is a flowchart showing an order of an inkjet printing method for a thin-film coating according to another embodiment of the present invention.
Figure 10:
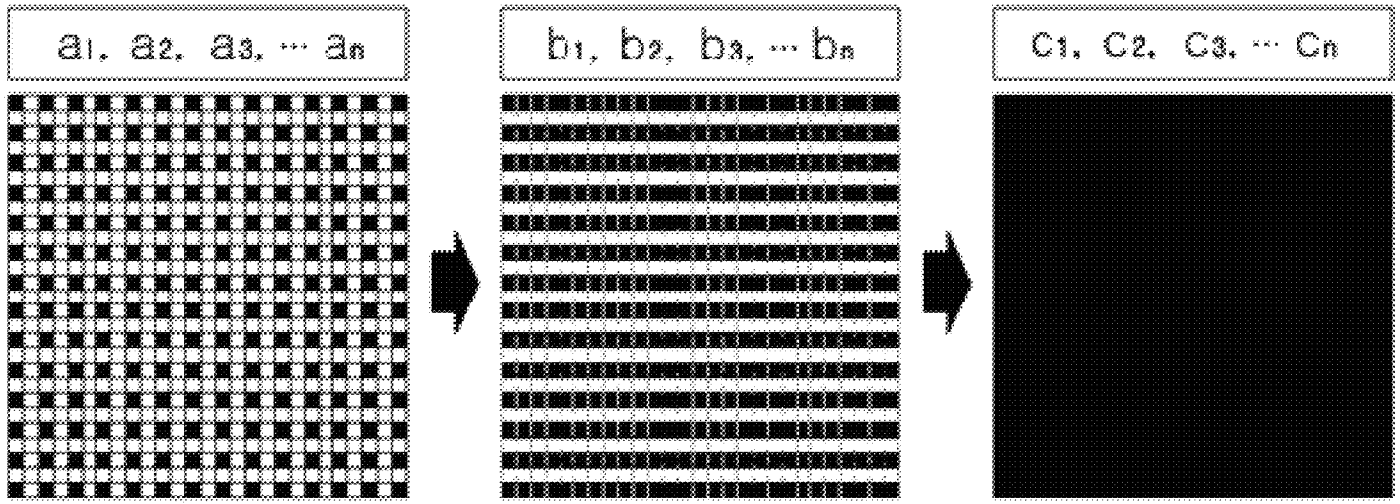
FIG. 10 is a view illustrating a detailed printing process of the inkjet printing method for the thin-film coating according to another embodiment of the present invention.

FIG. 9 is a flowchart illustrating a procedure of an inkjet printing method for a thin-film coating according to another embodiment of the present invention, and FIG. 10 is a view illustrating a detail printing process of the inkjet printing method for a thin-film coating according to another embodiment of the present invention. Another embodiment of the present invention will be described with reference to FIGS. 9 and 10.

The inkjet printing method for a thin-film coating according to another embodiment simultaneously performs, at once, the second connection pattern printing process S22 and the finishing printing process S30 according to the above-described embodiment.

Specifically, the droplets may be printed only on the position of the upper left pixel in the dot pattern printing process S10, the droplets may be printed only on the position of the upper right pixel in the connection pattern printing process S20, and the droplets may be printed simultaneously on the lower right pixel and the lower left pixel in the finishing printing process S30.

For a specific example, when the inkjet head module includes total 100 nozzles that are serially arranged with the pitch P1, the nozzle group for forming the dot pattern may include odd or even numbered nozzles of $1^{st}$ to $50^{th}$ nozzles, the nozzle group for forming the connection pattern may include odd or even numbered nozzles of $26^{th}$ to $75^{th}$ nozzles, and the nozzle group for finishing may include all nozzles of $51^{th}$ to $100^{th}$ nozzles.

For another example, the nozzle group for forming the dot pattern may include odd or even numbered nozzles of $1^{st}$ to $50^{th}$ nozzles, the nozzle group for forming the first connection pattern may include odd or even numbered nozzles of $20^{th}$ to $70^{th}$ nozzles, the nozzle group for forming the second connection pattern and finishing may include all nozzles of $51^{th}$ to $100^{th}$ nozzles. That is, each of the nozzle groups may be configured with a gap of one or a plurality of nozzles.

For a specific example, when the inkjet head module includes total 55 nozzles that are serially arranged with the pitch P1, the nozzle group for forming the dot pattern may include odd or even numbered nozzles of $1^{st}$ to $50^{th}$ nozzles, the nozzle group for forming the connection pattern may include odd or even numbered nozzles of $3^{rd}$ to $52^{nd}$ nozzles, and the nozzle group for finishing may include all nozzles of $6^{th}$ to $55^{th}$ nozzles.

As described above, as the printing is performed by three processes of the dot pattern printing process S10, the connection pattern printing process S20, and the finishing printing process S30, the coating may be performed at a fast speed although the ink discharge characteristic deviation is slightly greater than the above-described embodiments of the four processes.

While the present invention has been particularly shown and described with reference to the accompanying drawings according to exemplary embodiments, it will be understood by those of ordinary skill in the art that various changes in form and details may be made therein without departing from the spirit and scope of the present invention as defined by the following claims. Hence, the real protective scope of the present invention shall be determined by the technical scope of the accompanying claims.

What is claimed is:

1. An inkjet printing method for a thin-film coating, the method comprising:

a dot pattern printing process of printing a dot pattern by discharging ink at a preset position on a surface of an object using a nozzle group for forming a dot pattern so that dropped droplets are not in overlap with each other;

a connection pattern printing process of printing a connection pattern group by discharging ink at a position between a plurality of neighboring patterns using a nozzle group for forming a connection pattern so that the same attractive force acts to the plurality of neighboring patterns dropped on the surface of the object; and a finishing printing process of finishing a coating on the surface of the object by discharging ink to an area except for a plurality of neighboring dropped droplets using a nozzle group for finishing so that the same attractive force act to the plurality of dropped droplets that are dropped on the surface of the object.

2. The inkjet printing method of claim 1, wherein at least two groups of the nozzle group for forming the dot pattern, the nozzle group for forming the connection pattern, and the nozzle group for finishing comprise different nozzles in a head module.

3. The inkjet printing method of claim 1, wherein a size of a droplet discharged through the nozzle group for forming the dot pattern, a size of a droplet discharged through the nozzle group for forming the connection pattern, and a size of a droplet discharged through the nozzle group for finishing are equal to or different from each other.

4. The inkjet printing method of claim 1, wherein at least one process of the dot pattern printing process, the connection pattern printing process, and the finishing printing process discharges a plurality of droplets at the same position to adjust a coating thickness.

5. The inkjet printing method of claim 1, wherein a coating thickness is adjusted by adjusting a resolution in a printing direction in the dot pattern printing process, the connection pattern printing process, and the finishing printing process.

6. The inkjet printing method of claim 1, wherein a ratio between a diameter (D) of the droplet dropped through the dot pattern printing process and a pitch (P1) between the dropped droplets is $38\% < D/P1 < 93\%$.

7. The inkjet printing method of claim 1, wherein a ratio between a gap (G) between the patterns dropped through the connection pattern printing process and a pitch (P2) between the dropped patterns is $9\% < G/P2 < 64\%$.

8. The inkjet printing method of claim 1, wherein a pixel group comprising four pixels of an upper left pixel, an upper right pixel, a lower left pixel, and a lower right pixel, which are neighbored on the surface of the object, is arranged in a grid array, wherein printing is performed only on a position corresponding to one predetermined pixel of the four pixels in the dot pattern printing process;

printing is performed only on a position corresponding to one predetermined pixel of the rest three pixels in the connection pattern printing process; and printing is performed only on a position corresponding to one predetermined pixel or two predetermined pixels of the rest two pixels in the finishing printing process.

9. The inkjet printing method of claim 1, wherein the connection pattern printing process comprises:

a first connection pattern printing process of printing a first connection pattern group by discharging ink between a plurality of neighboring dot patterns using a nozzle group for forming the first connection pattern so that the same attractive force acts to the plurality of neighboring dot patterns dropped on the surface of the object; and a second connection pattern printing process of printing a second connection pattern group by discharging ink between the plurality of neighboring first connection patterns using a nozzle group for forming the second connection pattern so that the same attractive force acts to the plurality of neighboring first connection pattern dropped on the surface of the object.

10. The inkjet printing method of claim 9, wherein the nozzle group for forming the first connection pattern and the nozzle group for forming the second connection pattern comprise different nozzles in a head module.

11. The inkjet printing method of claim 1, further comprising:

a leveling process of leveling a coating formed on the surface of the object that has undergone the dot pattern printing process, the connection pattern printing process, and the finishing printing process; and a curing process of curing the coating formed on the surface of the object.

* * * * *